United States Patent [19]

Jacobs

[11] 4,257,820

[45] Mar. 24, 1981

[54] METHOD FOR REMOVING THE RUBBER LINING FROM A RUBBER-LINED VESSEL

[75] Inventor: Patrick D. Jacobs, Lake Jackson, Tex.

[73] Assignee: The Dow Chemical Company, Midland, Mich.

[21] Appl. No.: 57,611

[22] Filed: Jul. 13, 1979

[51] Int. Cl.[3] ..... B08B 5/00; B08B 5/02; B08B 9/00

[52] U.S. Cl. ..... 134/22 R; 134/30; 134/31; 134/37; 134/38; 156/344

[58] Field of Search ..... 134/11, 31, 22 R, 30, 134/37, 38; 156/344

[56] References Cited

U.S. PATENT DOCUMENTS

| | | | |
|---|---|---|---|
| 2,291,862 | 8/1942 | Bailey | 219/13 |
| 2,394,760 | 2/1946 | Felton | 134/37 X |
| 2,409,402 | 10/1946 | Thompson et al. | 134/31 |
| 2,571,328 | 10/1951 | Baker | 134/31 X |
| 2,857,922 | 10/1958 | Effinger | 134/11 UX |
| 2,956,911 | 10/1960 | Jelen | 134/31 X |
| 3,093,528 | 6/1963 | Reich | 156/285 |
| 3,103,572 | 9/1963 | Ewald | 219/19 |
| 3,335,088 | 8/1967 | Mandell | 156/344 X |
| 3,501,385 | 3/1970 | Jasberg | 204/12 |
| 3,663,293 | 5/1972 | Surprenant et al. | 134/11 |
| 3,832,235 | 8/1974 | Cooper et al. | 134/31 |
| 3,985,572 | 10/1976 | Petermann et al. | 134/22 R X |

*Primary Examiner*—Marc L. Caroff
*Attorney, Agent, or Firm*—M. W. Barrow

[57] ABSTRACT

A method for removing the rubber lining from rubber-lined vessels. A pool of solvent is maintained in the bottom of the vessel and heated to produce vapors which will penetrate the rubber lining and attack the adhesive bonding agent which attaches the rubber lining to the vessel wall. This vapor attack is maintained until the adhesive bonding agent is sufficiently weakened to allow sufficient air to be blown between the rubber lining and the wall to separate them.

5 Claims, 5 Drawing Figures

METHOD FOR REMOVING THE RUBBER LINING FROM A RUBBER-LINED VESSEL

BACKGROUND OF THE INVENTION

This invention relates to the loosening and removal of rubber linings from rubber-lined vessels. Heretofore, the rubber linings of rubber-lined vessels have generally had to be removed by such physically laborious methods as pulling and chipping the rubber off the vessel with clamps, clippers, hammers, and chisels.

It would be advantageous to eliminate such physically arduous methods by other means. This is accomplished by the method of the present invention.

SUMMARY OF THE INVENTION

The invention is a method for loosening the rubber attached to the interior walls of a sealable rubber lined vessel wherein the rubber is attached to these vessel walls by an adhesive bonding agent. This loosening method comprises at least partially vaporizing a liquid solvent within the vessel with the requirements that the solvent be a solvent for the adhesive bonding agent and being capable of penetrating the rubber lining. Preferably, the vessel is sealed after introducing the solvent into the vessel. Usually the vessel walls are cleaned, such as by steam, before the solvent is introduced into the vessel. Then the solvent is vaporized within the vessel for a time sufficient to substantially dissolve the adhesive bonding agent. It is preferred to elevate the temperature of the vapors.

The solvent is normally liquid, and a sufficient amount is placed in the reservior to form a pool which will produce vapors for a time sufficient to loosen the rubber lining by penetrating said lining and substantially dissolving the adhesive bonding agent. The vaporization of fumes from this liquid solvent is substantially accelerated by elevating the temperature of the liquid.

The invention also comprises a method of removing such rubber linings from such vessel walls. This method comprises the step of loosening the rubber lining with a solvent as described above in this summary of the invention and the further step of pushing large sections of the rubber lining away from the wall to which it is still loosely attached by injecting a fluid between the rubber lining and the vessel wall. Usually this liquid is a gas, preferably compressed air. It is introduced through at least one small hole cut in the rubber lining.

These and other features of the invention will be better appreciated by reference to the drawing wherein like parts in the several figures are referred to by like reference numbers.

DETAILED DESCRIPTION OF THE PREFERRED EMBODIMENT

Figure 1:
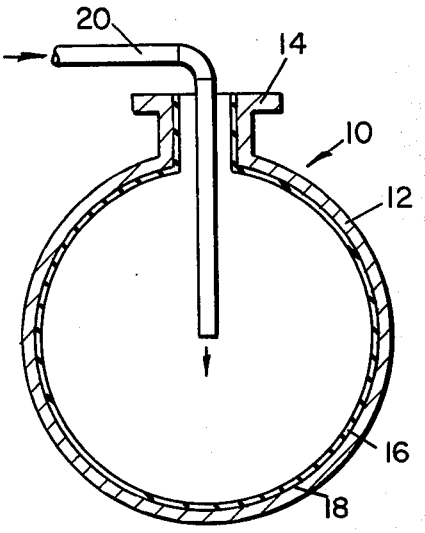
FIG. 1 is a sectional view of a front elevation of a rubber-lined vessel 10 showing cleansing steam being flowed into the vessel.

Referring to the drawings, the rubber-lined vessel of the vessel of FIGS. 1–4 will be referred to by reference number 10. Vessel 10 can be any substantially sealable vessel capable of being rubber lined. Typical vessels are metal barges, tank cars, storage tanks, large diameter pipes used for transporting and/or storing corrosive liquids, and chemical process vessels such as ion exchange tanks. Vessel 10 in FIGS. 1–4 is one of several similar cylindrically-shaped, horizontally disposed vessels which are part of a marine barge used in shipping corrosive liquids over water. Vessel 10 is comprised of a close-ended cylindrical wall 12, a manway 14, and a rubber lining 16 bonded to the interior of vessel wall 12 by an adhesive bonding agent 18. Typical bonding agents are: Goodyear Plioweld M-721-C, M-723-C, M-755-C and M-756-C; Arco 14 and Arco 27. Adhesive bonding agent 18 is difficult to show in these figures because of its slimness of dimension, but it lies between the interior of wall 12 and rubber lining 16.

Rubber-lining 16 in vessel 10 is Goodyear LS-551 rubber. Representative of other types of rubber used are Martin PG-70 and Arco 866.

The preferred method of loosening and removing rubber lining 16 from vessel wall 12 is as follows.

Step 1

The interior of vessel 10 is heated with steam for about twenty-four hours via steam entering vessel 10 by steam conduit 20 (see FIG. 1). The purpose of this steam heating is to remove corrosive materials from the rubber and to heat tank 10. After 24 hours, the steam is cut off, line 20 removed, and the water condensate from the steam is removed from the interior of vessel 10.

Step 2

Figure 2:
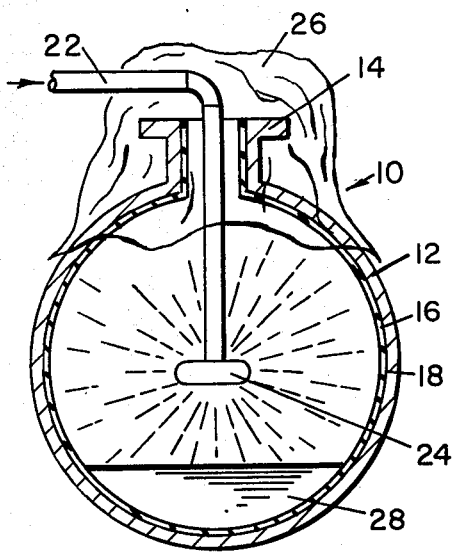
FIG. 2 is a sectional view of a front elevation of vessel 10 showing the introduction of a solvent into vessel 10 by spraying.

Methylene chloride is then pumped into the interior of vessel 10 via line 22 and a Butterworth machine 24 (see FIG. 2). The Butterworth machine functions somewhat like a lawn sprinkler in that it sprays the methylene chloride all around so that the total rubber lining 16 is well washed with liquid methylene chloride. Butterworth machines are made by Butterworth, Inc., with offices in Bayonne, N.J.

A tarpaulin 26 is draped over manway 14 while the methylene chloride is being pumped into vessel 10 to prevent substantial escape of methylene chloride fumes to the external environment. Sufficient methylene chloride is introduced into vessel 10 so that a pool 28 of it is formed in the bottom of vessel 10 which is of great enough volume to continue to produce copious vapors in the vaporization step, Step 3, below.

Figure 3:
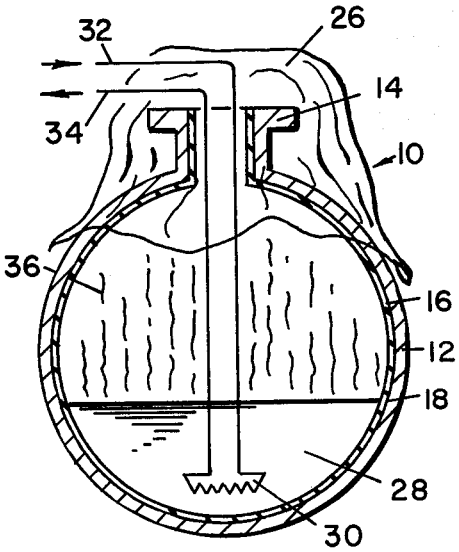
FIG. 3 is a sectional view of a front elevation of vessel 10 showing the liquid solvent pooled in the bottom of vessel 10 being heated.

Methylene chloride is preferred, but other solvents can be used. Representative of such other solvents are acetone, ethylene dichloride, benzene, carbon tetrachloride, ethyl ether, normal-heptane, and methyl alcohol. Of course, proper care should be taken to protect personnel and the environment from over exposure to any such solvent. In some cases, the use of tarpaulin 26 would not provide sufficient sealing. In that event, taps (not shown) would have to be used to connect solvent feed pipes 22 to tank 10, and manway 14 would have to be closed off to form a completely sealed tank. Normally, however, tank 10 is substantially sealed by draping tarpaulin 26 over open manway 14, pipes 22, and lines 32 and 34 as shown in FIG. 2 and FIG. 3.

In the present step a pool, 28, of about one foot in depth of liquid methylene chloride is sufficiently ample for vessel 10 when vessel 10 is about 12 feet in diameter. Rubber lining 16 is about ¼ inch thick except around fittings where it is about ½ inch thick. The rubber lining 16 is made of a 3 ply gum rubber, and the adhesive bonding agent 18 is Goodyear M-755-C.

Step 3

After completion of the introduction of methylene chloride to vessel 10, line 22 and Butterworth machine 24 are removed. Entrance steam line 32, steam heater 30, and exit steam line 34 are then placed in vessel 10 as shown in FIG. 3. Steam enters heater 30 from steam line 32 and exits through steam line 34. Steam heater 30 is maintained in methylene chloride liquid pool 28. Steam heater 30 elevates the temperature of pool 28 to a temperature of from about 105° F. to about 125° F. for a time of from about 24 hours to about 36 hours. This elevated temperature causes sufficient methylene chloride fumes or vapord 36 to form so that the gaseous space inside vessel 10 above pool 28 is virtually saturated. In appearance, these vapors 36 look like a very dense fog. Methylene chloride vapors 36, as well as the liquid methylene chloride in pool 28, slowly penetrate rubber lining 16 and attack adhesive bonding agent 18. This attack is maintained until the bonding agent is sufficiently weakened to loosen rubber lining 16 from vessel wall 12 to the point where rubber lining 16 can be blown away from vessel wall 12 by compressed air injected between vessel wall 12 and rubber lining 16.

During this evaporation step, Step 3, the tarpaulin 26 is maintained over manway 14 to substantially seal vessel 10 to prevent undue escape of methylene chloride vapors 36 into the environment external to vessel 10.

After the proper time has elapsed and the conditions of the adhesive bonding layer are such as just described, steam heater 30, steam line 32 and steam line 34 are removed. The remaining methylene chloride is pumped out and the vessel 10 ventilated until it is free of methylene chloride vapors.

Step 4

Figure 4:
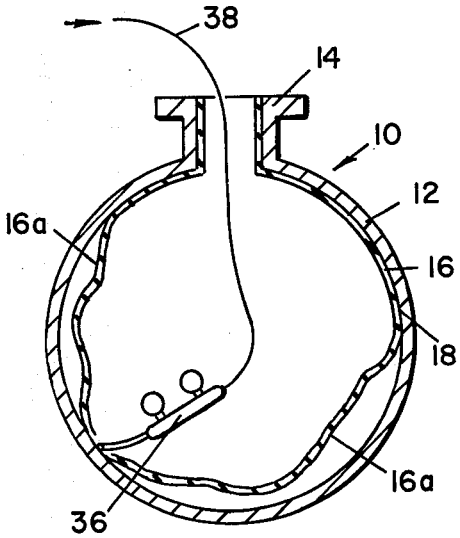
FIG. 4 is a sectional view of a front elevation of vessel 10 showing compressed air being injected between the interior of vessel wall 12 and its rubber lining 16 to blow rubber lining 16 away from the interior of vessel wall 12.

Referring to FIG. 4 for this step, air lance 36, attached to air line 38, is inserted into vessel 10. See FIG. 5 for a more detailed view of air lance 36.

Figure 5:
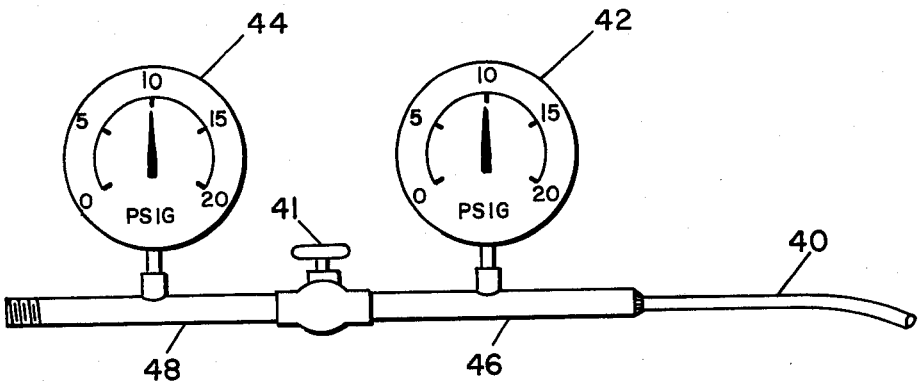
FIG. 5 is an enlarged side elevation of the air lance 36 shown in FIG. 4.

Referring to FIG. 4 and FIG. 5, air exit tube 40 of air lance 36 is inserted into a ¼ inch diameter hole cut completely through rubber lining 16 to vessel wall 12. Compressed air is injected between rubber lining 16 and vessel wall 12. This air expands outwardly between vessel wall 12 and rubber lining 16 finishing breakage of any bonding still maintained by adhesive agent 18 between rubber lining 16 and wall 12. This air forces large surfaces of rubber lining 16 to balloon out from wall 12 so that they appear like rubber-lining sections 16*a* in FIG. 4. These loosened sections 16*a* are easily cut with a knife and manually removed from vessel 10. Another ¼ inch hole is then drilled in rubber-lining 16 at a location where the air did not reach and the air injection process repeated. This repetition continues until all of rubber lining 16 is removed from vessel wall 12. About 75–100 square feet of air is ballooned away with each air injection.

The air injected air lance 36 is regulated by valve 41 and is monitored by air pressure meters 42 and 44. Air flows into tube 40 from pipes 46 and 48. In FIG. 4, pipe 40 is connected to conduit tube 38.

What is claimed is:

1. A method for loosening the rubber lining from interior walls of a vessel when said rubber lining is bonded to said walls by an adhesive, which method comprises:

a. substantially sealing the vessel off from fluid communication with the environment external to the vessel;

b. within the sealed vessel, at least partially vaporizing a solvent whose vapors are not only a solvent for the adhesive, but also are capable of penetrating the rubber lining so that it can substantially dissolve the agent bonding the rubber to the interior walls of the vessel for a time sufficient for the vaporized solvent to penetrate the rubber and substantially dissolve the bonding agent; and c. injecting air between the vessel wall and the rubber lining through a small hole cut through the rubber lining following the vaporization of the solvent.

2. A method for removing the rubber lining from interior walls of a sealable vessel when said walls have a rubber lining attached to them by an adhesive bonding agent, which method comprises:

a. introducing a liquid solvent into the vessel in sufficient quantity to form a pool at the bottom of the vessel, which liquid solvent is readily vaporizable, which is capable of substantially dissolving the adhesive bonding agent, and which is capable of penetrating the rubber lining to reach the adhesive bonding agent;

b. substantially sealing off the vessel to maintain solvent vapors within the vessel;

c. elevating the temperature of the liquid solvent to cause it to vaporize more readily for a time period which is sufficient to allow the solvent vapors to penetrate the rubber lining and substantially dissolve the adhesive bonding agent; and d. injecting air between the rubber lining and the vessel wall, through at least one hole cut in the rubber lining, in sufficient quantities to push large sections of the rubber lining away from the vessel wall.

3. The method of claim 1 which further comprises washing the exposed side of the rubber lining with the liquid solvent prior to step (a).

4. The method of claim 1 which further comprises cleansing the rubber lining with steam prior to introducing the liquid solvent into the vessel.

5. The methods of claims 2, 1 or 3 wherein the solvent is methylene chloride.

* * * * *